US005863021A

United States Patent [19]

Nichols

[11] Patent Number: 5,863,021

[45] Date of Patent: Jan. 26, 1999

[54] MULTIPLE FASTENER

[76] Inventor: Clark C. Nichols, 6311 Legionville Dr. N., Brainerd, Minn. 56401

[21] Appl. No.: 628,081

[22] Filed: Apr. 8, 1996

[51] Int. Cl.[6] ..... A47B 96/06

[52] U.S. Cl. ..... 248/229.23; 24/332; 248/229.13; 248/231.51; 248/316.75; 248/316.7

[58] Field of Search ..... 298/229.23, 229.26, 298/229.13, 229.16, 331.51, 316.7, 316.5; 24/331, 332

[56] References Cited

U.S. PATENT DOCUMENTS

| | | | |
|---|---|---|---|
| 281,543 | 7/1883 | Mayo | 24/331 X |
| 292,412 | 1/1884 | Covell | 24/332 X |
| 1,826,037 | 10/1931 | Allen | 24/332 X |
| 2,089,111 | 8/1937 | Bussey | 248/229.13 |
| 2,166,884 | 7/1939 | White | 24/332 X |
| 2,171,665 | 9/1939 | Meltzer | 248/229.26 X |
| 2,321,563 | 6/1943 | Penley | 24/332 X |
| 3,543,633 | 12/1970 | Batten | 248/229.23 X |
| 4,045,844 | 9/1977 | Murray | 24/331 |
| 5,118,065 | 6/1992 | Becklund et al. | 248/231.51 X |

FOREIGN PATENT DOCUMENTS

| | | | |
|---|---|---|---|
| 11514 | 7/1889 | United Kingdom | 248/231.51 |

*Primary Examiner*—Derek J. Berger
*Attorney, Agent, or Firm*—Westman, Champlin & Kelly

[57] ABSTRACT

A holding device has a first arm with a first and a second end and an intermediate portion extending between the first and second ends with and an attachment portion disposed in the intermediate portion. A second arm also has first and second ends, an intermediate portion extending between the first and second ends and an attachment portion disposed in the intermediate portion. The first and second arms are pivotally attached to one another at the attachment portions thereof. A third arm has first and second end portions and an intermediate portion extending therebetween. The third arm portion is pivotally attached at an attachment portion to the intermediate portion of the second arm. A biasing system is coupled to the first, second and third arms and biases the first ends of the first and second arms toward one another and the second ends of the second and third arms toward one another.

6 Claims, 2 Drawing Sheets

52
18
58
26
53
60
1
56
10
22
44
32
24
12
30
20
2
46
34
64
62
14
1
36
70
48
50
16
2
40
28
42
72
2
66
38
68

MULTIPLE FASTENER

BACKGROUND OF THE INVENTION

The present invention deals with an attachment or holding device. More particularly, the present invention deals with a dual or multiple holding device.

Clasps and holding devices have been known for many years. However, such clasps and holding devices typically include a pair of generally opposing arm portions which are biased toward one another. The clasp or holding device holds the item to be secured between those two generally opposed arms. Therefore, if the clasp is to be used to attach the item to be secured to another item or to a structure, the generally opposing arm portions must be secured about both the item to be secured and the structure. The generally opposing arm portions then exert a force which causes the item to be secured and the structure to come into frictional contact with one another. In this way, the item is secured to the structure.

Such clasps or holding devices suffer from a number of drawbacks. For instance, if one desires to remove the item which is secured to the structure from the clasps, one must release the clasp or holding device so that not only does the item which was secured to the structure become unsecured, but the clasp also becomes unsecured from the structure. In other words, the item to be secured is only removable if the entire clasp is removed from the structure. This can result in cumbersome and time consuming operation.

In addition, such prior clasps or holding devices are typically not formed or shaped to accommodate a wide variety of structures. Therefore, they have only limited utility.

Further, many such prior art clasps are formed so the generally opposed arm portions have a substantially constant width. Many such arm portions have a fairly small width. This results in an undesirably low amount of frictional contact between the clasping arm portions and the structure and can cause the holding device to be easily, and accidentally, dislodged from the structure to which it is attached.

In addition, many prior art clasps or holding devices can only be attached to the structure after performance of a number of mechanical steps. While this may provide a secure, and relatively fixed, attachment of the clasping device to the structure, it can be cumbersome and inefficient. In some circumstances, such devices can be quite impractical. For instance, certain activities, such as golf, require the golfer to carry or have accessible a variety of different implements. Also, it is common in the golf industry for golfers to rent carts for only a single round or for a single day of golf. If a clasping or holding device is to be used by the golfer, those which require a number of mechanical operations to connect the holding device to the golf cart would simply be impractical.

SUMMARY OF THE INVENTION

The present invention arises, in part, from the realization that there is a continuing need for clamping and holding devices which are easily and quickly installed on a wide variety of structures and which are formed to hold or secure a wide variety of implements to such structures.

A holding device has a first arm with a first and second end and an intermediate portion extending between the first and second ends with and an attachment portion disposed in the intermediate portion. A second arm also has first and second ends, an intermediate portion extending between the first and second ends and an attachment portion disposed in the intermediate portion. The first and second arms are pivotally attached to one another at the attachment portions thereof. A third arm has first and second end portions and an intermediate portion extending therebetween with an attachment portion disposed in the intermediate portion. The third arm portion is pivotally attached at the attachment portion thereof to the intermediate portion of the second arm. A biasing system is coupled to the first, second and third arms and biases the first ends of the first and second arms toward one another and the second ends of the second and third arms toward one another.

DETAILED DESCRIPTION OF THE PREFERRED EMBODIMENTS

Figure 1:
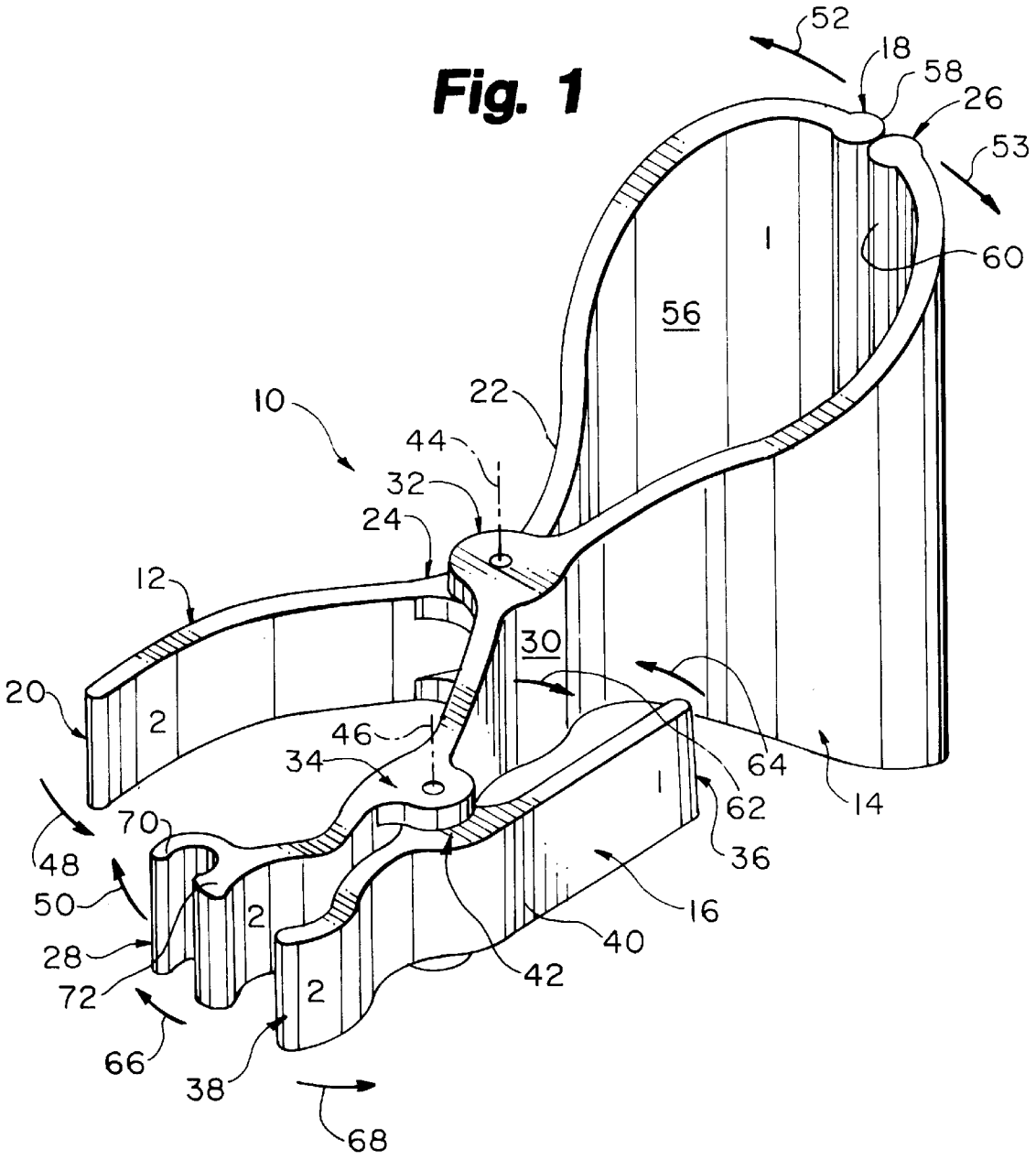
FIG. 1 is a perspective view of a holding device according to the present invention.

FIG. 1 illustrates clip 10 according to the present invention. Clip 10 includes first arm 12, second arm 14 and third arm 16. First arm 12 has a first end 18 and a second end 20. An intermediate portion 22 extends between the first and second ends 18 and 20. An attachment portion 24 is disposed in the intermediate portion 22.

Second arm 14 also has a first end 26, a second end 28 and an intermediate portion 30 extending between the first and second ends, 26 and 28. A first attachment portion 32 and a second attachment portion 34 are both disposed in the intermediate portion 30.

Third arm 16 also has a first end 36, a second end 38 and an intermediate portion 40 extending between the first and second ends 36 and 38. An attachment portion 42 is disposed in the intermediate portion 40.

Arms 12 and 14 are pivotally connected to one another at attachment portions 24 and 32. Arms 12 and 14 pivot relative to one another about an axis 44 generally defined by attachment portions 24 and 32.

Arms 14 and 16 are also pivotally attached to one another at attachment portions 34 and 42. Arms 14 and 16 pivot relative to one another about an axis 46 generally defined by attachment portions 34 and 42.

Figure 2:
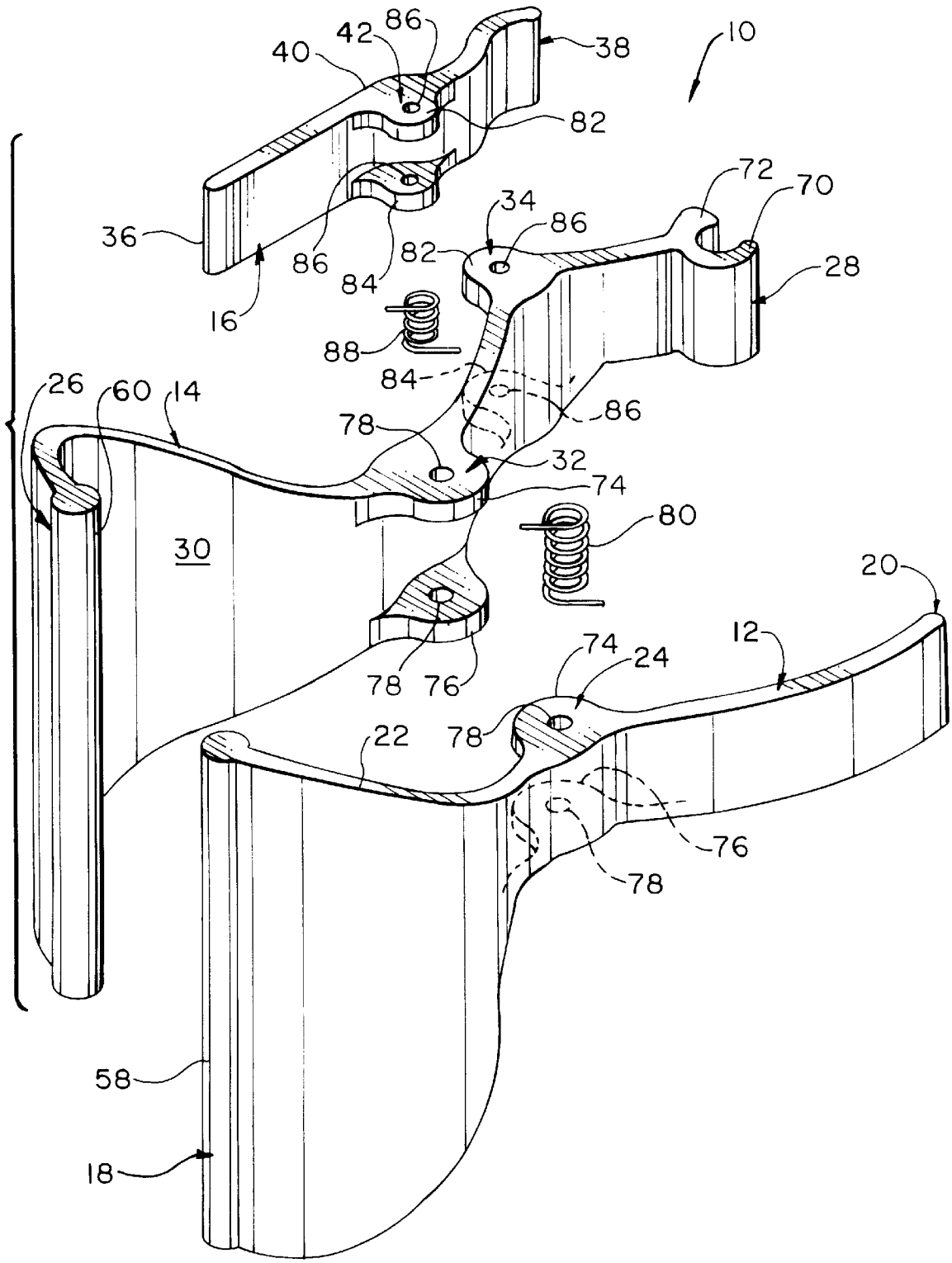
FIG. 2 is an exploded view of the holding device shown in FIG. 1.

In operation, first ends 18 and 26 of arms 12 and 14 are preferably biased into contact with one another by a biasing system described in more detail with respect to FIG. 2. In addition, second ends 28 and 38 of arms 14 and 16 are also biased toward, or into contact with, one another by a bias system described in more detail with respect to FIG. 2. Therefore, holding device 10 forms a first clip or clasp defined by first ends 18 and 26 of arms 12 and 14 and a second clip or clasp defined by the second ends 28 and 38 of arms 14 and 16.

In order to secure holding device 10 to another structure, the operator exerts a force on the second ends 20 and 28 of arms 12 and 14 to overcome the biasing force and move second ends 20 and 28 toward one another in the directions indicated by arrows 48 and 50. This causes the first ends 18 and 26 of arms 12 and 14 to come out of contact with one another and move away from one another in the direction indicated by arrows 52 and 54, thus opening the first clip. Holding device 10 can then be mounted about the structure by placing a portion of the structure between the first ends 18 and 26 of arms 12 and 14 (i.e., within the first clip). The operator then releases second ends 20 and 28 of arms 12 and 14 to allow the biasing system to bias first ends 18 and 26 toward one another again in a direction opposite arrows 52 and 54. This causes the first clip to grasp and hold onto the portion of the structure between arms 12 and 14. The intermediate portions 22 and 30 of arms 12 and 14 are substantially a concave or C-shape relative to one another. In other words, the intermediate portions 22 and 30 of arms 12 and 14 extend first away from one another and then back toward one another along a line generally extending from the first ends 18 and 26 of arms 12 and 14 toward the second ends 20 and 28 of arms 12 and 14. This allows the first clip to be configured about structures or portions thereof having a wide variety of shapes. More specifically, the intermediate portions 22 and 30 of arms 12 and 14 define a generally cylindrical passage 56 between the attachment portions 24 and 32 thereof and the first ends 18 and 26 thereof. This cylindrical passage 56 substantially makes the holding device 10 flexible in that it can be clipped to a wide variety of structural configurations.

It should also be noted that first ends 18 and 26 of arms 12 and 14 terminate in rounded or cylindrical portions 58 and 60. Cylindrical portions 58 and 60 are gently curved so that clip 10 does not tend to scratch or damage the structure to which it is attached. Also, the enlarged generally cylindrical portions 58 and 60 allow the first clip to be attached over a structure which has a lip. The enlarged cylindrical portions 58 and 60 provide extra grasping surface to grasp the lip of the structure.

The biasing system which is described in more detail with respect to FIG. 2 biases the second ends 28 and 38 of arms 14 and 16 toward one another, or into contact with one another. Therefore, the first ends 28 and 38 of arms 14 and 16 generally define a second clip for holding an implement or accessory. In operation, the operator simply exerts a force on the intermediate portion 30 of arm 12 and the first end 36 of arm 16 in the direction indicated by arrows 62 and 64 to move those portions of arms 14 and 16 relatively toward one another. This causes the second ends 28 and 38 of arms 14 and 16 to move away from one another in the directions indicated by arrows 66 and 68. This opens the second clip. After placing an implement or accessory to be held by holding device 10 into the second clip, the operator simply releases the intermediate portion 30 of arm 14 and the first end 36 of arm 16 and allows them to move away from one another in directions generally opposite arrows 62 and 64. This causes first ends 28 and 38 to come into frictional contact with, and exert a force on, the accessory or implement being held in the second clip. Therefore, the operator can use the second clip to hold and release various implements or accessories without ever detaching holding device 10 from the structure to which the first clip is attached.

As with the first clip, the second clip also has a generally cylindrical cavity defined thereby. In other words, the arm portions 14 and 16 in the area of the second clip extend first away from one another and then toward one another to accommodate a wide variety of accessories or implements. Further, the second end 28 of arm 12 preferably terminates in a pair of generally opposing fingers 70 and 72. These fingers define another holding space or clip which can be used to hold yet another accessory.

FIG. 2 is an exploded view of device 10. Similar items are similarly numbered to those shown in FIG. 1. FIG. 2 better illustrates that the attachment portions 24 and 32 of arms 12 and 14 each include generally opposing flanges 74 and 76 each of which have an aperture 78 therein. Flanges 74 and 76 of arms 12 are separated by a distance which is less than the distance separating flanges 74 and 76 of arm 14. Therefore, flanges 74 and 76 of arm 12, when assembled, are sandwiched between flanges 74 and 76 of arm 14 and all apertures 78 are positioned to be aligned with one another.

After the two arms 12 and 14 are moved into position relative to one another, a spring 80 is then fit between flanges 74 and 76 of arm 12 so that its inner axial diameter is aligned with aperture 78. Then, a pin or other suitable connection device (not shown) is inserted through and seated within apertures 78 of flanges 74 and 76 of arms 12 and 14 and within the inner axial diameter of spring 80. This provides the pivotal connection between arms 12 and 14 and the biasing of arms 12 and 14 into contact with one another at the first ends 18 and 26 thereof.

In addition, the attachment portions 34 and 42 of arms 14 and 16 have a similar arrangement. Flanges 82 and 84 are provided and nest within one another such that apertures 86, therein, are axially aligned. Spring 88 is then inserted between the inner flanges 82 and 84 and biases the arms in the desired direction.

In the preferred embodiment, the various pieces of holding device 10 are injection molded pieces and, once formed, are substantially rigid.

It can therefore be seen that holding device 10 provides an apparatus with two clips thereon. One clip is formed for securing holding device 10 to another structure, such as a fishing boat, a golf cart, or any other suitable structure or piece. The other clip is fastened to support one or more accessories or implements. The accessories or implements can be removed from the second clip portion without detaching holding device 10 from the structure to which it is attached with the first clip portion. This provides convenient and efficient operation of the device.

It should also be noted that while the present description has proceeded with respect to two clips, a third clip, substantially identical to the second clip, can be disposed using a fourth arm pivotally attached to first arm 12 in the same manner as arms 14 and 16 are attached.

Although the present invention has been described with reference to preferred embodiments, workers skilled in the art will recognize that changes may be made in form and detail without departing from the spirit and scope of the invention.

What is claimed is:

1. A holding device, comprising:

a first arm having a first end and a second end;

a second arm having a first end and a second end, the first and second arms being pivotally attached to one another between the first and second ends, the extent between the first ends and attachment of the first and second arms defining a first clip and the extent between the second ends and attachment of the first and second arms defining first and second arm first clip handles for operating the first clip;

a third arm having a first end and a second end, the third arm being pivotally attached to the second arm first clip handle and moveable therewith to operate the first clip, a portion of the second arm first clip handle and a portion of the third arm forming a second clip and another portion of the second arm first clip handle and another portion of the third arm forming second and third arm second clip handles;

a biasing system coupled to the first, second and third arms and biasing the first ends of the first and second arms toward one another and the second ends of the second and third arms toward one another; and a third clip coupled to one of said first, second, or third arms, said first, second, and third clips being aligned in parallel axes, and said first clip facing in a first direction, and the second and third clips facing a second common direction opposite to the direction of the first clip, the third clip being formed of opposed flexible receiving fingers forming a generally "C"-shaped clip.

2. A holding device comprising:

first and second arms having a first size, said first and second arms being pivotally attached to form a first clip;

a third arm pivotally attached to one of said first or second arms, the third arm being sized smaller than the first and second arms and pivotally attached to the first or second arm such that the combination of the third arm and a portion of the first or second arm form a second clip sized smaller than the first clip; and a third clip coupled to one of said first, second, or third arms, said first, second, and third clips having receiving openings being aligned in parallel axes, and said receiving opening of the first clip facing in a first direction, and the receiving openings of the second and third clips facing in a second common direction opposite to the receiving opening of the first clip.

3. The holding device of claim 2 wherein the first and second arms have first and second ends, said first and second arms being pivotally attached to form the first clip extending between the attachment of the first and second arms to the first ends, the extent between the attachment of the first and second arms and the first ends having a varied dimension along a portion of the length thereof, the dimension being greater at the first ends than at the attachment of the first and second arms to define larger surface area grasping portions of the first clip.

4. The holding device of claim 2 wherein the third clip is coupled to the second arm.

5. A holding device, comprising:

a first arm having a first end and a second end;

a second arm having a first end and a second end, the first and second arms being pivotally attached to one another between the first and second ends, the extent between the first ends and attachment of the first and second arms defining a first clip and the extent between the second ends and attachment of the first and second arms defining first and second arm first clip handles for operating the first clip;

a third arm having a first end and a second end, the third arm being pivotally attached to the second arm first clip handle and moveable therewith to operate the first clip, a portion of the second arm first clip handle and a portion of the third arm forming a second clip and another portion of the second arm first clip handle and another portion of the third arm forming second and third arm second clip handles;

a biasing system coupled to the first, second and third arms and biasing the first ends of the first and second arms toward one another and the second ends of the second and third arms toward one another; and a third clip coupled to the second arm, said first, second, and third clips being aligned in parallel axes, and said first clip facing in a first direction, and the second and third clips facing a second common direction opposite to the direction of the first clip.

6. An accessory clip system, comprising:

first and second arms pivotally attached to one another to form a first clip having a first handle for operating the first clip and a clip portion, the first and second arms forming first and second handle portions of the first handle;

a third arm pivotally attached to the first or second handle portions of the first handle and moveable therewith to operate the first clip, a portion of the third arm and a portion of the first or second handle portions of the first handle forming a second clip, and another portion of the third arm and another portion of the first or second handle portions of the first handle forming a second handle of the second clip; and a third clip coupled to the second arm and the first, second and third clips having receiving openings aligned in parallel axes, and said receiving opening of the first clip facing in a first direction, and the receiving openings of the second and third clips facing in a second common direction opposite to the direction of the receiving opening of the first clip.

* * * * *